US005499584A

United States Patent [19]

Taylor

[11] Patent Number: 5,499,584

[45] Date of Patent: Mar. 19, 1996

[54] RETRACTABLE ADJUSTABLE SHELF APPARATUS

[76] Inventor: Michael J. Taylor, 6 B Durban Ct., Baltimore, Md. 21236-5133

[21] Appl. No.: 350,458

[22] Filed: Dec. 7, 1994

[51] Int. Cl.[6] ..... A47B 57/00

[52] U.S. Cl. ..... 108/96; 108/97; 108/39; 312/266

[58] Field of Search ..... 108/99, 96, 97, 108/100, 39, 2; 312/110, 319.3, 325, 27, 266; 211/90, 104; 248/585, 284, 421

[56] References Cited

U.S. PATENT DOCUMENTS

| | | | |
|---|---|---|---|
| 544,821 | 8/1895 | Morrison | 108/99 X |
| 1,529,032 | 3/1925 | Meisner et al. | 312/266 |
| 1,824,822 | 9/1931 | Kradolfer | 108/97 X |
| 2,641,072 | 6/1953 | Maher | 108/99 X |
| 2,692,173 | 10/1954 | Lowitzsch | 108/24 X |
| 2,938,631 | 5/1960 | Brey | 211/90 |
| 3,857,623 | 12/1974 | Schneller | 312/266 |
| 4,258,965 | 3/1981 | Stoner | 312/266 |
| 4,375,907 | 3/1983 | Vanderkooi et al. | 312/110 X |

*Primary Examiner*—Jose V. Chen
*Assistant Examiner*—Janet M. Wilkens

[57] ABSTRACT

A retractable adjustable shelf apparatus for holding items thereupon comprising a hollow first shelf formed of a top and a bottom wall and a periphery interconnecting the walls; a pair of brace mechanisms with each brace mechanism including a strut having a first end and a second end with the first end pivotally couplable to a separate external second shelf; and a pair of level adjustment mechanisms disposed within the first shelf, each level adjustment mechanism further comprising an elongated longitudinally slidable geared upper track slidably coupled to the top wall, an elongated geared lower track coupled to the bottom wall, a gear disposed between and in mesh with the tracks and with the gear coupled to the second end of the strut, and a spring-loaded bolt extended from one end of the upper track and through the front wall to terminate at a turnable knob for allowing the first track to be slid to a desired position for permitting the levelness of the first shelf to be adjusted when pivoted with respect to the external second shelf.

7 Claims, 3 Drawing Sheets

RETRACTABLE ADJUSTABLE SHELF APPARATUS

BACKGROUND OF THE INVENTION

1. Field of the Invention

The present invention relates to a retractable adjustable shelf apparatus and more particularly pertains to holding items in a stowed configuration with a retractable adjustable shelf apparatus.

2. Description of the Prior Art

The use of shelf mechanisms is known in the prior art. More specifically, shelf mechanisms heretofore devised and utilized for the purpose of holding items thereupon are known to consist basically of familiar, expected and obvious structural configurations, notwithstanding the myriad of designs encompassed by the crowded prior art which have been developed for the fulfillment of countless objectives and requirements.

By way of example, U.S. Des. Pat. No. 292,860 to Motta discloses a closet shelf. U.S. Pat. No. 3,538,842 to Labbato discloses fixtures for closets. U.S. Pat. No. 4,154,420 to Mazie et al. discloses a closet shelf and pole arrangement. U.S. Pat. No. 4,285,484 to Follows discloses a shelf and clothes rod assembly for a closet. U.S. Pat. No. 4,697,713 to Pryor discloses a closet storage arrangement. U.S. Pat. No. 4,951,908 to Kallio discloses a shelf assembly for a closet.

While these devices fulfill their respective, particular objective and requirements, the aforementioned patents do not describe a retractable adjustable shelf apparatus that allows items to be held stowed thereon in a raised orientation yet allow the items to be readily accessed in a lowered orientation.

In this respect, the retractable adjustable shelf apparatus according to the present invention substantially departs from the conventional concepts and designs of the prior art, and in doing so provides an apparatus primarily developed for the purpose of holding items thereupon.

Therefore, it can be appreciated that there exists a continuing need for new and improved retractable adjustable shelf apparatus which can be used for holding items thereupon. In this regard, the present invention substantially fulfills this need.

SUMMARY OF THE INVENTION

In the view of the foregoing disadvantages inherent in the known types of shelf mechanisms now present in the prior art, the present invention provides an improved retractable adjustable shelf apparatus. As such, the general purpose of the present invention, which will be described subsequently in greater detail, is to provide a new and improved retractable adjustable shelf apparatus and method which has all the advantages of the prior art and none of the disadvantages.

To attain this, the present invention essentially comprises, in combination, a rectangular rigid planar hollow first shelf. The first shelf is formed of a horizontal top wall, a horizontal bottom wall, and a periphery interconnecting the top wall and the bottom wall with the periphery further formed of a vertical front wall, a vertical rear wall, and opposed vertical side walls. A rectangular rigid planar second shelf is also included. The second shelf has a horizontal top surface, a horizontal bottom surface, and a periphery interconnecting the surfaces with the periphery further having a vertical front edge, a vertical rear edge, and opposed vertical side edges. A pair of rigid brace mechanisms are included with each brace mechanism extended between the shelves. Each brace mechanism is formed of two elongated spaced equally-sized struts with each strut having a first end pivotally adjustably coupled to the top surface of the second shelf near a side edge thereof, a second end, an intermediate location therebetween, a first segment extended arcuately from the first end to the intermediate location, and second segment extended linearly from the intermediate location to the second end to thereby define a perpendicular bend coincident with the intermediate location. A pair of level adjustment mechanisms are included with each level adjustment mechanism disposed within the first shelf at location near a separate side wall thereof. Each level adjustment mechanism further includes an elongated longitudinally slidable geared upper track slidably coupled to the top wall, an elongated geared lower track coupled to the bottom wall, a pair of gears disposed between and in mesh with the tracks and with each gear coupled to a separate second end of a strut, and a spring-loaded bolt extended from one end of the upper track and through the front wall to terminate at a knob. The knob is turnable for allowing the first track to be slid to a desired position for permitting the levelness of the first shelf to be adjusted when pivoted with respect to the second shelf. A pair of handles are included and coupled to the front wall of the first shelf for allowing the first shelf to be readily grasped and placed in a first position above and aligned with the second shelf and a second position below and offset from the second shelf. An eyelet is coupled to the front wall between the handles and defining a through hole for receipt of a pull cord for allowing the first shelf to be drawn downward to the second position. Lastly, a foam pad is included and coupled to the rear wall of the first shelf for dampening noise generated as the rear wall is abutted against a recipient supporting surface when placed in the first position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved retractable adjustable shelf apparatus which has all the advantages of the prior art shelf mechanisms and none of the disadvantages.

It is another object of the present invention to provide a new and improved retractable adjustable shelf apparatus which may be easily and efficiently manufactured and marketed.

It is a further object of the present invention to provide a new and improved retractable adjustable shelf apparatus which is of durable and reliable construction.

An even further object of the present invention is to provide a new and improved retractable adjustable shelf apparatus which is susceptible of a low cost of manufacture with regard to both materials and labor, and which accordingly is then susceptible of low prices of sale to the consuming public, thereby making such a retractable adjustable shelf apparatus economically available to the buying public.

Still yet another object of the present invention is to provide a new and improved retractable adjustable shelf apparatus which provides in the apparatuses and methods of the prior art some of the advantages thereof, while simultaneously overcoming some of the disadvantages normally associated therewith.

Even still another object of the present invention is to provide a new and improved retractable adjustable shelf apparatus for holding items thereupon.

Lastly, it is an object of the present invention to provide a new and improved retractable adjustable shelf apparatus comprising a hollow first shelf formed of a top wall, a bottom wall, and a periphery interconnecting the top wall and bottom wall with the periphery further formed of a front wall, a rear wall, and opposed side walls; a pair of brace mechanisms with each brace mechanism including a strut having a first end and a second end with the first end pivotally couplable to a separate external second shelf; and a pair of level adjustment mechanisms with each level adjustment mechanism disposed within the first shelf at location near a separate side wall thereof, each level adjustment mechanism further comprising an elongated longitudinally slidable geared upper track slidably coupled to the top wall, an elongated geared lower track coupled to the bottom wall, a gear disposed between and in mesh with the tracks and with the gear coupled to the second end of the strut, and a spring-loaded bolt extended from one end of the upper track and through the front wall to terminate at a knob, and with the knob being turnable for allowing the first track to be slid to a desired position for permitting the levelness of the first shelf to be adjusted when coupled to an pivoted with respect to a separate external second shelf.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
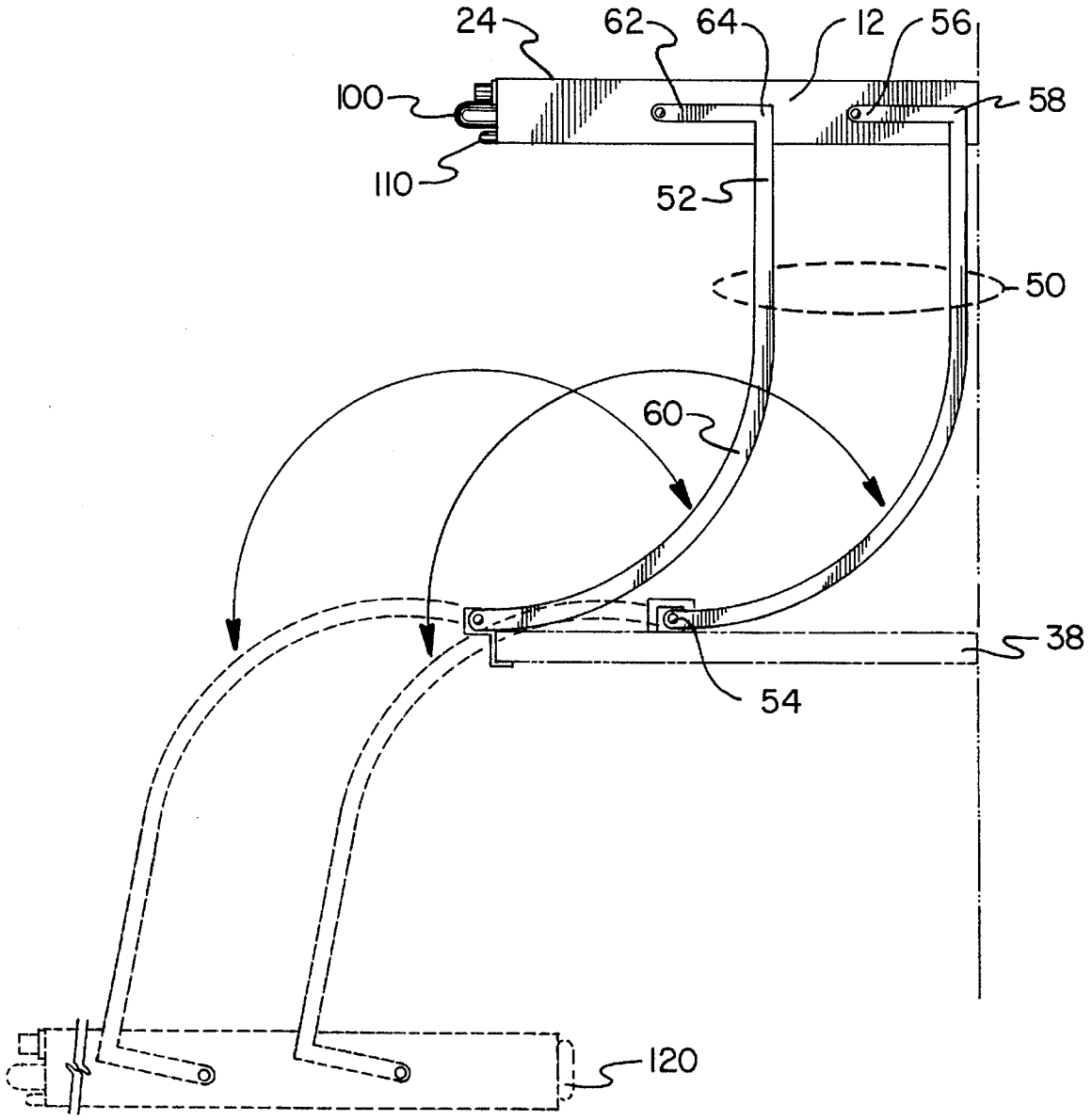
FIG. 1 is a side-elevational view of the preferred embodiment constructed in accordance with the principles of the present invention shown in both an upward retracted position and a downward extended position.
Figure 2:
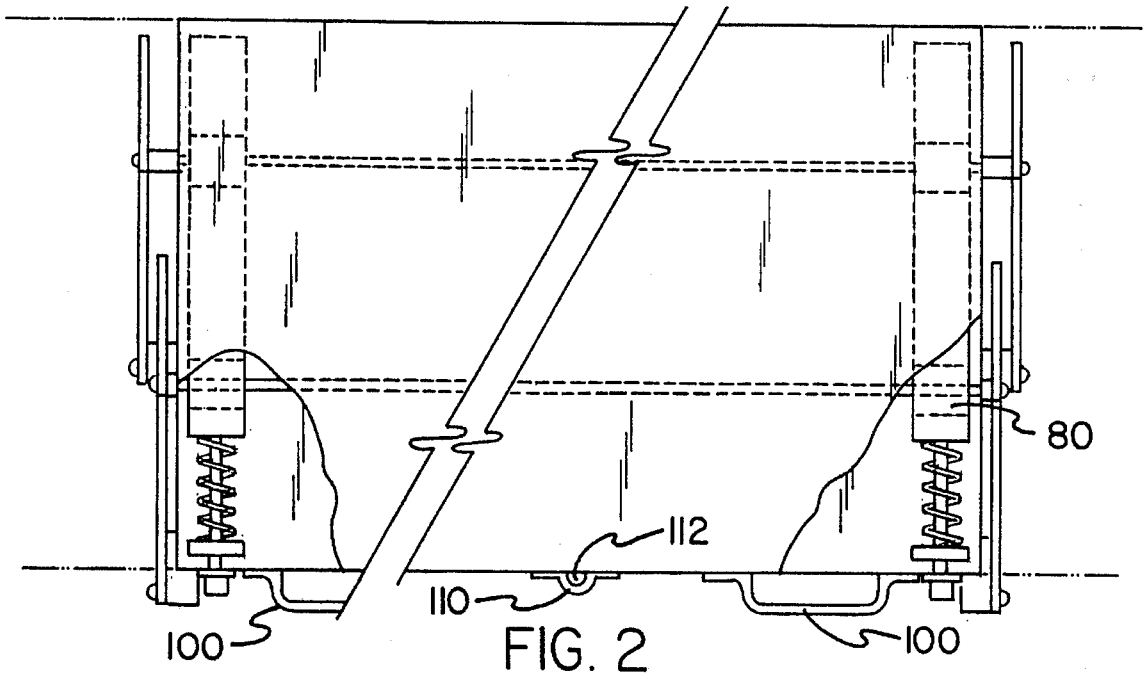
FIG. 2 is a plan view of the second shelf of the present invention further depicting the level adjustment mechanisms contained therein.
Figure 3:
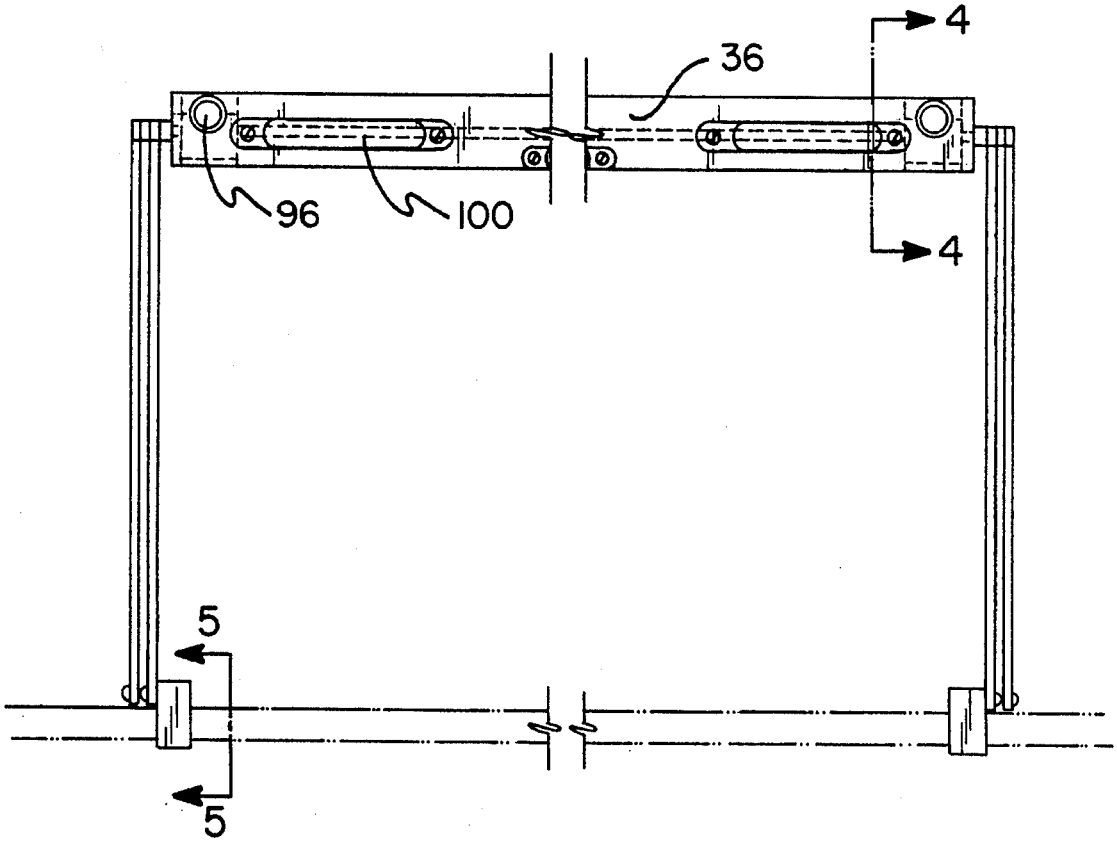
FIG. 3 yet another side-elevational view of the present invention.
Figure 4:
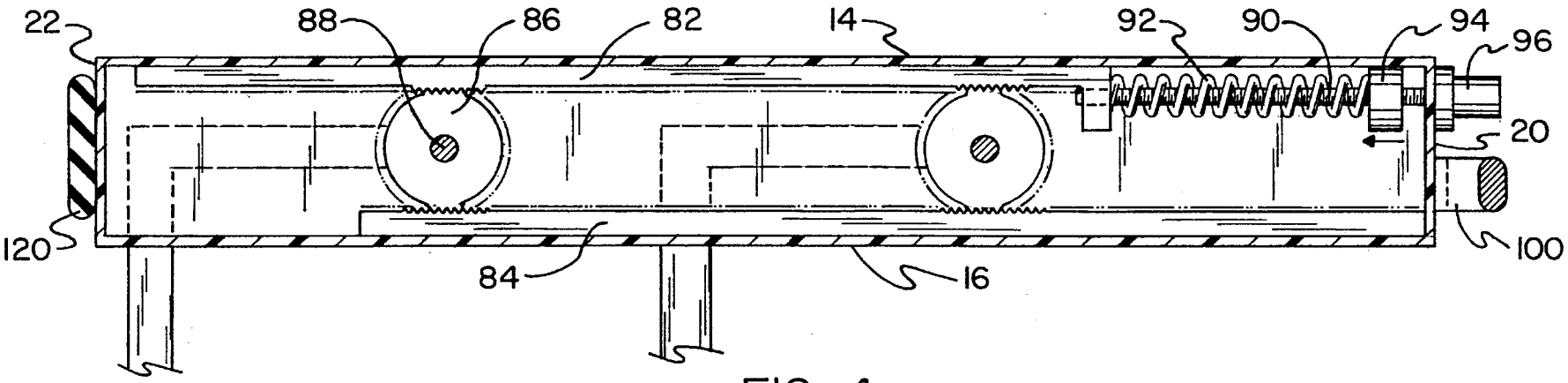
FIG. 4 is a cross-sectional view of the present invention taken along the line 4—4 of FIG. 3.
Figure 5:
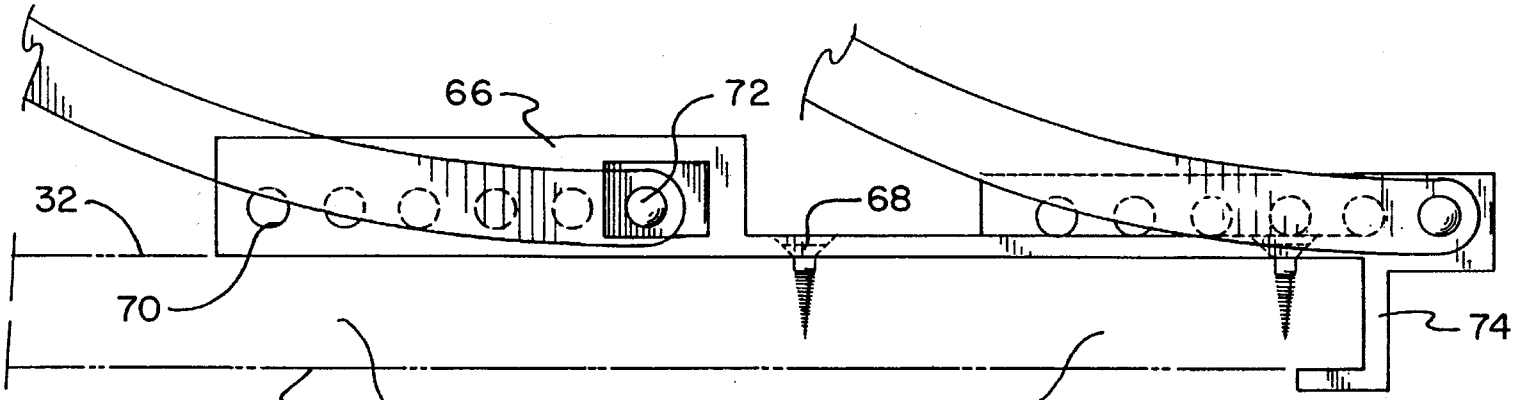
FIG. 5 is yet another side elevational view of the present invention taken along the line 5—5 of FIG. 3.

With reference now to the drawings, and in particular, to FIG. 1 thereof, the preferred embodiment of the new and improved retractable adjustable shelf apparatus embodying the principles and concepts of the present invention and generally designated by the reference number 10 will be described.

The present invention is comprised of a plurality of components. In their broadest context, such components include a first shelf, a second shelf, brace mechanisms, adjustment mechanisms, handles, an eyelet, and a pad. Such components are individually configured and correlated with respect to each other to provide the intended function of supporting items thereon in a stowed configuration.

More specifically, the adjustable shelf apparatus includes a first shelf 12. The structure of the shelf is rectangular and planar. It has a hollow interior formed therein. The shelf is made of a rigid material such as metal or plastic. The shelf is formed of a horizontal planar top wall 14, a horizontal planar bottom wall 16, and a periphery 18 perpendicularly interconnecting the top wall and the bottom wall. The periphery is formed of a vertical planar front wall 20, a vertical planar rear wall 22 and opposed vertical planar side walls. The shelf is resilient enough to hold items thereon without one of the walls collapsing inward toward the interior.

Also provided is a second shelf 30. The second shelf has a rectangular planar structure. It is formed of a rigid solid material such as metal or plastic. The second shelf has a horizontal planar top surface 32, a horizontal planar bottom surface 34 and a periphery perpendicularly interconnecting the surfaces. The periphery of the second shelf is formed of a vertical planar front edge 36, a vertical planar rear edge 38 and opposed vertical planar side edges 40. The second shelf can also be provided with a set of mounting brackets for mounting the shelf to a recipient vertical external surface such as a wall.

A pair of rigid and spaced brace mechanisms 50 are extended between the first shelf and the second shelf. Each brace mechanism is formed of two elongated, rigid and spaced struts 52. Each strut is formed of a rigid material such as metal or plastic. The struts are equally-sized and shaped. Each strut has a first end 54, a second end 56, and an intermediate location 58 therebetween. Each strut also includes a first segment 60 extended arcuately upwards from the first end to the intermediate location. The strut also has a second segment 62 extended linearly and generally horizontally from the intermediate location to the second end to thereby create a perpendicular bend 64 or corner that is coincident with the intermediate location. Each first end of each strut is pivotally and adjustably coupled to the top surface of the second shelf near one of its side edges with a mounting bracket 66. Two mounting brackets are included with each positioned near a side edge of the second shelf. The mounting brackets are affixed to the second shelf with a plurality of threaded screws 68. Each mounting bracket has a sequence of through holes 70 disposed thereon in a generally horizontal fashion. An integral pin 72 or detent is extended through the through hole and connected to the first end of the strut to complete the coupling. This pin is removable and subsequently disposable in one of the many through holes on the mounting bracket. Thus, the strut is adjustable with respect to the first shelf, thereby allowing the first shelf to be positioned and offset with respect to the second shelf. The mounting bracket also has a lip 74 extended over the front edge of the second shelf to insure its rigid securement.

In order to ensure that the first shelf maintains a level position with respect to the second shelf, a pair of level adjustment mechanisms 80 are provided. The level adjustment mechanisms are formed of a rigid material such as metal or plastic. Each level adjustment mechanism is disposed within the first shelf 12. Each level mechanism is positioned at a location near a separate side wall 24 within the first shelf. Each level adjustment mechanism comprises an elongated and longitudinally slidable geared upper track 82. The upper track is slidably coupled to the top wall 14. The level adjustment mechanism also includes an elongated geared lower track 84 coupled to the bottom wall 16 at a location below and in parallel with the upper track. A pair of spaced gears 86 are disposed between and in mesh with the tracks. Each gear is coupled to a separate second end 56 of a strut with a gear pin 88. The gear pins are projected through the side walls of the first shelf to complete the coupling. Each level adjustment mechanism also includes a threaded bolt 90. The threaded bolt is extended from one end of the upper track and through the front wall of the first shelf. A helical spring 92 is extended around the threaded bolt and held in a biased position against the upper track through the use of an eyelet 94 projected downwards from the top wall of the first shelf. The end of the bolt extended through the front wall and terminated at a knob 96. The knob is turnable by hand for allowing the first track to be slid to a desired position with respect to the lower track through force applied through the spring-loaded bolt. The spring-loaded bolt is used to fine tune the level adjustment of the first shelf. By moving the first track longitudinally with respect to the lower track, the levelness of the first shelf may be adjusted when stationary or when it is being pivoted with respect to the second shelf. Thus, the gears are allowed to rotatably traverse along the rails in order to maintain the level orientation of the first shelf. The level adjustment mechanisms allow the first shelf to remain level during an entire range of motion when pivoted with respect to the second shelf. As the first shelf is pulled downwards or upwards, the gears rotate between the tracks to allow it to remain essentially level.

A pair of handles 100 are also provided. The handles are coupled to the front wall 20 of the first shelf. The handles allow the first shelf to be readily grasped and placed in a first position above and aligned in parallel with the second shelf. The handles also allow the first shelf to be placed in a second position below and offset from the second shelf. In the second position, the second shelf projects outward from the recipient supporting surface to which the present invention is attached for use. Both of these positions are shown in FIG. 1.

An eyelet 110 is coupled to the front wall between the handles. The eyelet defines a through hole 112 when coupled to the front wall. This through hole is adapted for receipt of a pull cord. When a pull cord is secured within the through hole of the eyelet, the first shelf can be readily drawn downwards to the second position. Thus, the first shelf may be mounted at an elevated orientation that is generally out of reach of a user but accessible through the use of the pull cord.

A foam pad 120 is coupled to the rear wall 22 of the first shelf. The foam pad dampens noise generated as the rear wall of the first shelf is abutted against a recipient supporting surface when placed in the first position. Furthermore, the foam pad prevents the first shelf from being damaged as a result of being forcibly placed in the first position through user actuation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A retractable adjustable shelf apparatus for holding items thereupon comprising, in combination:

a rectangular rigid planar hollow first shelf formed of a horizontal top wall, a horizontal bottom wall, and a periphery interconnecting the top wall and the bottom wall with the periphery further formed of a vertical front wall, a vertical rear wall, and opposed vertical side walls;

a rectangular rigid planar second shelf having a horizontal top surface, a horizontal bottom surface, and a periphery interconnecting the surfaces with the periphery further having a vertical front edge, a vertical rear edge, and opposed vertical side edges;

a pair of rigid brace mechanisms with each brace mechanism extended between the shelves, each brace mechanism formed of two elongated spaced equally-sized struts with each strut having a first end pivotally adjustably coupled to the top surface of the second shelf near a side edge thereof, a second end, an intermediate location therebetween, a first segment extended arcuately from the first end to the intermediate location, and second segment extended linearly from the intermediate location to the second end to thereby define a perpendicular bend coincident with the intermediate location;

a pair of level adjustment mechanisms with each level adjustment mechanism disposed within the first shelf at location near a separate side wall thereof, each level adjustment mechanism further comprising an elongated longitudinally slidable geared upper track slidably coupled to the top wall, an elongated geared lower track coupled to the bottom wall, a pair of gears disposed between and in mesh with the tracks and with each gear coupled to a separate second end of a strut, and a spring-loaded bolt extended from one end of the upper track and through the front wall to terminate at a knob, and with the knob being turnable for allowing the first track to be slid to a desired position for allowing the levelness of the first shelf to be adjusted when pivoted with respect to the second shelf;

a pair of handles coupled to the front wall of the first shelf for allowing the first shelf to be readily grasped and placed in a first position above and aligned with the second shelf and a second position below and offset from the second shelf;

an eyelet coupled to the front wall between the handles and defining a through hole for receipt of a pull cord for allowing the first shelf to be drawn downward to the second position; and a foam pad coupled to the rear wall of the first shelf for dampening noise generated as the rear wall is abutted against a recipient supporting surface when placed in the first position.

2. A retractable adjustable shelf apparatus for holding items thereupon comprising:

a hollow first shelf formed of a top wall, a bottom wall, and a periphery interconnecting the top wall and bottom wall with the periphery further formed of a front wall, a rear wall, and opposed side walls;

a pair of brace mechanisms with each brace mechanism including a strut having a first end and a second end with the first end pivotally couplable to a separate external second shelf; and a pair of level adjustment mechanisms with each level adjustment mechanism disposed within the first shelf at location near a separate side wall thereof, each level adjustment mechanism further comprising an elongated longitudinally slidable geared upper track slidably coupled to the top wall, an elongated geared lower track coupled to the bottom wall, a gear disposed between and in mesh with the tracks and with the gear coupled to the second end of the strut, and a spring-loaded bolt extended from one end of the upper track and through the front wall to terminate at a knob, and with the knob being turnable for allowing the first track to be slid to a desired position for permitting the levelness of the first shelf to be adjusted when coupled to and pivoted with respect to a separate external second shelf.

3. The retractable adjustable shelf apparatus as set forth in claim 2 further including a second shelf having the first means of the struts of the bracing mechanisms adjustably pivotally coupled thereto such that the first shelf is positionable above and aligned with the second shelf and positionable below and offset from the second shelf when the second shelf is secured to an external recipient supporting surface.

4. The retractable adjustable shelf apparatus as set forth in claim 2 further including a handle coupled to the first shelf.

5. The retractable adjustable shelf apparatus as set forth in claim 2 further including an eyelet coupled to first shelf and defining a through hole for receipt of a pull cord.

6. The retractable adjustable shelf apparatus as set forth in claim 2 further including a pad coupled to the rear wall of the first shelf.

7. The retractable adjustable shelf apparatus as set forth in claim 2 wherein each strut, along with having the first end and second end, has an intermediate location therebetween, a first segment extended arcuately from the first end to the intermediate location, and second segment extended linearly from the intermediate location to the second end to thereby define a perpendicular bend coincident with the intermediate location.

* * * * *